United States Patent [19]

Dhanani et al.

[11] 4,400,288

[45] Aug. 23, 1983

[54] DETERGENT COMPOSITIONS AND PROCESSES OF MAKING THEREOF

[75] Inventors: Shafiq Dhanani, Whitley Bay; Ronald MacDonald, Alnwick; James S. Clunie, Whitley Bay; Maxim C. Brooks, Newcastle upon Tyne, all of England

[73] Assignee: The Procter & Gamble Company, Cincinnati, Ohio

[21] Appl. No.: 286,443

[22] Filed: Jul. 24, 1981

[30] Foreign Application Priority Data

Jul. 28, 1980 [GB] United Kingdom ..... 8024570
May 19, 1981 [GB] United Kingdom ..... 8115314

[51] Int. Cl.[3] ..... C11D 3/04
[52] U.S. Cl. ..... 252/135; 252/174.15
[58] Field of Search ..... 252/174.15, 135

[56] References Cited

U.S. PATENT DOCUMENTS

| | | | |
|---|---|---|---|
| 3,664,961 | 5/1972 | Norris | 252/99 |
| 3,746,653 | 7/1973 | Churchfield | 252/321 |
| 3,933,672 | 1/1976 | Bartolotta et al. | 252/116 |
| 4,010,110 | 3/1977 | Cosentino et al. | 252/174.15 |
| 4,075,118 | 2/1978 | Gault et al. | 252/135 |
| 4,136,045 | 1/1979 | Gault et al. | 252/135 |
| 4,199,465 | 4/1980 | Rodriguez | 252/174.15 |

*Primary Examiner*—John D. Smith
*Assistant Examiner*—Janyce A. Bell

[57] ABSTRACT

Foam-controlled detergent compositions comprising alkoxylated nonionic surfactant, polydimethylsiloxane foam-controller dispersed therein, and siloxane-oxyalkylene copolymer as dispersing agent therefor, the weight ratio of polydimethylsiloxane to dispersing agent lying in the range from 2:1 to 20:1. The compositions preferably also contain particulate silica in a weight ratio of polydimethylsiloxane to silica of from 20:1 to 200:1.

17 Claims, No Drawings

DETERGENT COMPOSITIONS AND PROCESSES OF MAKING THEREOF

TECHNICAL FIELD

This invention relates to detergent compositions. In particular, it relates to heavy duty detergent compositions having controlled sudsing characteristics especially when used in automatic washing machines for washing clothes and the like.

BACKGROUND

Detergent compositions normally contain surfactants which tend to produce foam when agitated in aqueous solution. For many applications, especially in automatic washing and dishwashing machines, excess foam production is a serious problem and with many effective surfactants it is necessary to add foam suppressing or controlling agents in order to achieve acceptable sudsing characteristics.

Unfortunately, it has been found that the addition of foam controlling agents can in itself create new problems. For example, monostearyl acid phosphate, which is one conventional controlling agent, is very effective and useful at low levels in product, but as the level of phosphate is increased to cope, for example, with increased surfactant, the material becomes incompletely soluble in the wash solution and precipitates out of solution onto utensil and machine surfaces leaving them coated with unsightly streaks and deposits.

Another type of foam controlling agent which has often been suggested is that based on silicones, especially polydimethylsiloxane. These materials are known to be very useful in industrial applications where the silicone is added directly to an aqueous solution containing a surfactant. However, they have not lived up to their promise when incorporated into detergent compositions; frequently, for example, they become inactivated in the presence of other detergent ingredients and require some type of special protection as disclosed, for instance, in U.S. Pat. No. 3,933,672. Also, in the case of granular compositions, addition of silicone foam-controllers can lead to problems of increased "wetting" of detergent substrate in an aqueous medium with the result that the product has poor dispensing characteristics in washing machines and leaves gel-like residues on the inside of the product dispenser. In addition, silicone foam-controllers can have a deleterious effect on the surface-feel of fabrics washed therein, and can also adversely affect the cleaning characteristics of detergent compositions.

One type of silicone-based foam-controller which requires no special protection to prevent inactivation in the presence of other detergent ingredients, is the so-called "self-emulsified" silicone class disclosed generally in British Pat. Nos. 1,533,610 and 1,544,736. The preferred self-emulsified foam-controller disclosed therein are those containing emulsifiers having at least one polyoxyalkylene moiety incorporated into a basic polysiloxane structure. Mixtures of these emulsifiers with polydimethylsiloxanes are also generally disclosed, the mixtures containing at least 50% of emulsifier and from about 5% to 45% of polydimethylsiloxane liquid.

Although the "self-emulsified" silicon foam-controllers disclosed above successfully overcome the inactivation problem in the presence of other detergent ingredients, they are still found to suffer a number of drawbacks which limit their commercial and practical value. In the first place, the "self-emulsified" silicones are found to be relatively inefficient foam-controllers, in other words, one requires a relatively high level of the foam regulating material for satisfactory performance. In addition, "self-emulsified" silicones are found to be relatively sensitive to the prevailing wash conditions (soil load, fabric/liquor ratio, wash temperature etc); in other words, "self-emulsified" silicones lack "robustness." Moreover, the "self-emulsified" silicones tend to have a flocculating effect on silica dispersions and this can lead to a loss of suds suppresion effectiveness after prolonged storage of the foam controller in a detergent composition.

The present invention thus provides a detergent composition having improved foam control characteristics, especially foam-controller efficiency, robustness and storage stability; it also provides a detergent composition having improved foam control without detriment to detergency performance or "feel" characteristics of fabrics washed therein: and it further provides a foam-controlled detergent composition having excellent dispensing characteristics in automatic washing machines.

SUMMARY OF THE INVENTION

Accordingly, the present invention provides a foam-controlled detergent composition characterized by from about 1.5% to about 100%, preferably from about 5% to about 60% of a mixture of:

(a) alkoxylated nonionic surfactant, (b) polydimethylsiloxane foam controller dispersed in at least part of the alkoxylated nonionic surfactant, and (c) siloxane-oxyalkylene copolymer as dispersing agent therefor, wherein the weight ratio of alkoxylated nonionic surfactant to polydimethylsiloxane foam controller is in the range from about 10:1 to about 100:1, preferably from about 25:1 to about 65:1, and the weight ratio of polydimethylsiloxane foam controller to siloxane-oxyalkylene copolymer is in the range from about 2:1 to about 20:1, preferably from about 5:1 to about 15:1, more preferably from about 8:1 to about 12:1.

All percentages quoted herein are by weight of the total detergent composition, unless otherwise specified.

In preferred compositions the nonionic surfactant is an ethoxylated nonionic surfactant having an average ethyleneoxy content of from about 35% to about 70%, especially from about 47.5% to about 67.5%, more especially from about 50% to about 62.5%. A preferred class of nonionic surfactant is the condensation product of a $C_8$ to $C_{24}$ primary or secondary aliphatic alcohol with from 2 to about 18 moles of ethylene oxide per mole of alcohol.

The compositions of the invention suitably contain from about 2% to about 35%, preferably from about 5% to about 20% of nonionic surfactant and from about 0.05% to about 0.75%, preferably from about 0.1% to about 0.4% in total of polydimethylsiloxane foam-controller and siloxane-oxyalkylene copolymer dispersing agent. Preferably, the polydimethylsiloxane foam controller is dispersed in the nonionic surfactant in combination with particulate silica in a weight ratio of siloxane:silica of from about 20:1 to about 200:1, more preferably from about 25:1 to about 100:1. Addition of the silica is valuable for enhancing the foam-controlling effectiveness of the present compositions. The storage stability of the resulting compositions is particularly sensitive to the ratio both of polydimethylsiloxane to silica and of polydimethylsiloxane to dispersant and control of both these parameters is therefore important for obtaining optimum performance.

Another valuable aspect of the present invention is the excellent granulometry and hydration characteristics found in relation to granular embodiments of the invention. Thus in a highly preferred embodiment, there is provided a granular detergent composition characterized by:

(a) from about 30% to about 99% of base powder comprising:
  (i) from about 1% to about 15% of organic surfactant selected from anionic, zwitterionic and ampholytic surfactants and mixtures thereof, and
  (ii) from 5% to 98% of a detergency builder, and
(b) from 1% to 30% of a premix of alkoxylated nonionic surfactant, dispersed polydimethylsiloxane foam controller, and siloxane-oxyalkylene copolymer dispersing agent sprayed in fluent form onto at least a part of the base powder.

The present invention also encompasses a surfactant premix for addition to a detergent composition for foam control purposes. The surfactant premix comprises:

(a) alkoxylated nonionic surfactant
(b) polydimethylsiloxane foam controller dispersed in the nonionic surfactant, and
(c) siloxane-oxyalkylene copolymer as dispersing agent therefor, wherein the weight ratio of alkoxylated nonionic surfactant to polydimethylsiloxane foam controller is in the range from about 10:1 to about 100:1, and the weight ratio of polydimethylsiloxane foam controller to siloxane-oxyalkylene copolymer is in the range from about 2:1 to about 20:1.

In a process aspect of the invention, there is provided a process for making the foam-controlled detergent compositions comprising the steps of forming the surfactant premix described above and subjecting the premix to high shear mixing. The premix is then preferably sprayed in fluent form onto a base powder composition comprising:

(a) organic surfactant selected from anionic, zwitterionic and ampholythic surfactants and mixtures thereof, and
(b) detergency builder to provide a final composition comprising from about 1% to about 30% of the surfactant premix, from about 30% to about 99% of the base powder, from about 1% to about 15% of the organic surfactant (a) and from about 5% to about 98% of the detergency builder (b).

Desirably, the surfactant premix is prepared by first preparing a premix of alkoxylated nonionic surfactant and siloxane-oxyalkylene copolymer dispersing agent, admixing the polydimethylsiloxane foam controller and, where present, particulate silica with the surfactant/dispersing agent mixture, and thereafter subjecting the total mixture to high shear mixing.

The individual components of the invention will now be discussed in more detail.

A wide range of alkoxylated nonionic surfactants can be used in the present compositions. A typical lising of the classes and species of these surfactants is given in U.S. Pat. No. 3,664,961 issued to Norris on May 23, 1972 and incorporated herein by reference.

Alkoxylated nonionic surfactants materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements. Preferably, the nonionic surfactants are ethoxylated surfactants. In general, ethoxylated nonionic surfactants suitable herein have an average ethyleneoxy content in the range from about 35% to about 70% and especially from about 50% to about 62.5% by weight of the surfactant.

Examples of suitable nonionic surfactants include the condensation products of primary or secondary aliphatic alcohols having from 8 to 24 carbon atoms, in either straight chain or branched chain configuration, with from 2 to about 18 moles of alkylene oxide per mole of alcohol. Preferably, the aliphatic alcohol comprises between 9 and 15 carbon atoms and is ethoxylated with between 2 and 9, desirably between 3 and 8 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 40% to 50% 2-methyl branching (Synperonic is a Trade Name of I.C.I.), or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 9, the condensation products of coconut alcohol with an average of between 5 and 9 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, for example, those ethoxylates of the Tergitol series having from about 9 to 15 carbon atoms in the alkyl group and up to about 11, especially from about 3 to 9, ethoxy residues per molecule.

Of the above, highly preferred are alkoxylated nonionic surfactants having an average HLB in the range from about 9.5 to 13.5, especially 10 to 12.5. Highly suitable nonionic surfactants of this type are ethoxylated primary $C_{9-15}$ alcohols having an average degree of ethoxylation from about 2 to 9, more preferably from about 3 to 8.

The polydimethylsiloxane foam controllers used herein are high molecular weight polymers having a molecular weight in the range from about 200 to about 200,000, and have a kinematic viscosity in the range from about 20 to 2,000,000 mm/s, preferably from about 500 to 50,000 mm/s, more preferably from about 3,000 to about 30,000 mm/s at 25° C. The siloxane polymer is generally end-blocked either with trimethylsilyl or hydroxyl groups but other end-blocking groups are also suitable. The polymer can be prepared by various techniques such as the hydrolysis and subsequent condensation of dimethyldihalosilanes, or by the cracking and subsequent condensation of dimethylcyclosiloxanes.

The polydimethylsiloxanes can also be present in combination with particulate silica. Such combinations of silicone and silica can be prepared by affixing the silicone to the surface of silica for example by means of the catalytic reaction disclosed in U.S. Patent 3,235,509. Foam regulating agents comprising mixtures of silicone and silica prepared in this manner preferably comprise silicone and silica in a silicone:silica ratio of from 20:1 to 200:1, preferably about 25:1 to about 100:1. The silica can be chemically and/or physically bound to the silicone in an amount which is preferably about 0.5% to 5% by weight, based on the silicone. The particle size of the silica employed in such silica/silicone foam regulating agents should preferably be not more than 100 millimicrons preferably from 10 millimicrons to 20 millimicrons, and the specific surface area of the silica should exceed about 50 $m^2/g$.

Alternatively, foam regulating agents comprising silicone and silica can be prepared by admixing a silicone fluid of the type herein disclosed with a hydrophobic silica having a particle size and surface area in the range disclosed above. Any of several known methods may be used for making a hydrophobic silica which can be employed herein in combination with a silicone as the foam regulating agent. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane.

A preferred foam regulating agent herein comprises a hydrophobic silanated (most preferably trimethylsilanated) silica having a particle size in the range from about 10 millimicrons to 20 millimicrons and a specific surface area above about 50 $m^2/g$ intimately admixed with a dimethyl silicone fluid having a molecular weight in the range of from about 500 to about 200,000, at a weight ratio of silicone to silanated silica of from about 20:1 to about 200:1, preferably from about 20:1 to about 100:1.

Yet another type of foam regulating agent suitable herein comprises polydimethylsiloxane fluid, a silicone resin and silica. The silicone "resins" used in such compositions can be any alkylated silicone resins, but are usually those prepared from methylsilanes. Silicone resins are commonly described as "three-dimensional" polymers arising from the hydrolysis of alkyl trichlorosilanes, whereas the silicone fluids are "two-dimensional" polymers prepared from the hydrolysis of dichlorosilanes. The silica components of such compositions are the microporous materials such as the fumed silica aerogels and xerogels having the particle sizes and surface areas herein-above disclosed.

The mixed polydimethylsiloxane fluid/silicone resin/silica materials useful in the present compositions can be prepared in the manner disclosed in U.S. Pat. No. 3,455,839. These mixed materials are commercially available from the Dow Corning Corporation. Preferred materials of this type comprise:

(a) from about 10 parts to about 100 parts by weight of a polydimethylsiloxane fluid having a viscosity in the range from 20 to 30,000 mm/s at 25° C.:

(b) 5 to 50 parts by weight of a siloxane resin composed of $(CH_3)_3SiO_{1/2}$ units and $SiO_2$ units in which the ratio of the $(CH_3)_3SiO_{1/2}$ units to the $SiO_2$ units is within the range of from 0.6/1 to 1.2/1: and (c) 0.5 to 5 parts by weight of a silica aerogel.

Such mixtures can also be sorbed onto and into a water-soluble solid.

The siloxane-oxyalkylene copolymer dispersing agent suitable for use herein has the general formula I:

$$R_aSiY_{4-a} \qquad \text{I}$$

wherein a is 0 or an integer from 1 to about 3, R is an alkyl group containing from 1 to about 30 carbon atoms, or a group of formula II:

$$R'(OR')_bOR'' \qquad \text{II}$$

wherein R' is an alkylene group containing from 1 to about 6 carbon atoms, b has a value of from 1 to about 100, preferably from 10 to 30; and R'' is a capping group which can be selected from hydrogen, alkyl, acyl, aryl, alkaryl, aralkyl or alkenyl groups containing up to about 20 carbon atoms, sulfate, sulfonate, phosphate, carboxylate, phosphonate, borate or isocyanate groups, or mixtures thereof; Y is a group having the formula III:

$$(-O-\underset{\underset{R}{|}}{\overset{\overset{R}{|}}{Si}}-)_c-OSiR_3 \qquad \text{III}$$

wherein R is as defined above and c has a value from 1 to about 200; and wherein at least one R group in the compound has the formula II.

Preferred dispersing agents of the above type are selected from copolymers having the general formulae IV to VII.

$$R_a'''Si\{(OSiMe_2)_p(OSiMeG)_qOSiMe_2G\}_{4-a} \qquad \text{IV}$$

$$R_a'''Si\{(OSiMe_2)_p(OSiMeG)_rOSiMe_3\}_{4-a} \qquad \text{V}$$

$$GMe_2Si(OSiMe_2)_p(OSiMeG)_qOSiMe_2G, \text{ and} \qquad \text{VI}$$

$$Me_3Si(OSiMe_2)_p(OSiMeG)_rOSiMe_3 \qquad \text{VII}$$

wherein R''' is a $C_{1-10}$ alkyl group, Me is methyl, G is the group of formula II, a has a value of 0 or 1, p has a value of at least 1, q has a value of 0 to about 50 and r has a value of 1 to about 50. Preferred dispersants contain G groups in non-terminal positions and contain a mixture of oxyethylene and oxypropylene groups, particularly in about a 1:1 ratio. Highly preferred are dispersants of formula VII having p+r from about 30 to about 120 with the ratio p:r from about 2:1 to about 8:1.

The compositions of the invention can be supplemented by all manner of detergent components. A highly preferred additional component is from about 1% to about 15%, especially from about 2% of about 8% of organic surfactant selected from anionic, zwitterionic and ampholytic surfactants and mixtures thereof.

Suitable synthetic anionic surfactants are water-soluble salts of alkyl benzene sulfonates, alkyl sulfates, alkyl polyethoxyl ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic detergents includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminum trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10}$–$C_{18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued December 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solublizing group, e.g. carboxy, sulfonate, sulfate, phosphate, or phosphonate.

Suitable zwitterionic surfactants are water soluble derivatives of aliphatic quaternary ammonium phosphonium and sulfonium cationic compounds in which the aliphatic moieties can be straight chain or branched, and wherein one of the aliphatic substituents contains from about 8 to 18 carbon atoms and one contains an anionic water-solubilizing group.

The composition of the invention can also contain from about 5% to about 98% of detergency builder, preferably from about 20% to about 80% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates and bicarbonate.

Examples of suitable organic alkaline detergency builder salts are:

(1) water-soluble amino polyacetates, e.g. sodium and potassium ethylendiaminetetraacetates, nitrilotriacetates, and N-(2-hydroxyethyl)nitrilodiacetates;

(2) water-soluble salts of phytic acid, e.g. sodium and potassium phytates;

(3) water-soluble polyphosphonates, including, sodium, potassium and lithium salts of ethane-1-hydroxy-1,1-diphosphonic acid; sodium, potassium and lithium salts of methylenediphosphonic acid and the like.

(4) water-soluble polycarboxylates such as the salts of lactic acid, glycollic acid and ether derivatives thereof as disclosed in Belgian Pat. Nos. 821,368, 821,369 and 821,370; succinic acid, malonic acid, (ethylenedioxy) diacetic acid, maleic acid, diglycollic acid, tartaric acid, tartronic acid and fumaric acid; citric acid, aconitic acid, citraconic acid, carboxyemethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Pat. No. 1,425,343.

Mixtures of organic and/or inorganic builders can be used herein. One such mixture of builders is disclosed in Canadian Pat. No. 755,038, e.g. a ternary mixture of sodium tripolyphosphate, trisodiumnitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143 published Mar. 24, 1976, German Patent Application No. OLS. No. 2,433,485 published Feb. 6, 1975, an OLS No. 2,525,778 published Jan. 2, 1976, the disclosures of which are incorporated herein by reference.

Another suitable component of the present compositions is a water-soluble magnesium salt which is added at levels in the range from about 0.015% to about 0.2%, preferably from about 0.03% to about 0.15% and more preferably from about 0.05% to about 0.12% by weight of the compositions (based on weight of magnesium). Suitable magnesium salts include magnesium sulfate, magnesium sulfate heptahydrate, magnesium chloride, magnesium chloride hexahydrate, magnesium fluoride and magnesium acetate. Desirably, the magnesium salt is added to the compositions as part of the aqueous slurry crutcher mix and is then converted to dry granular form, for instance by spray drying. The magnesium salt can provide additional low temperature stain removal benefits as described in copending British Patent Application No. 80/15542.

Bleaching agents can also be incorporated in the compositions of the present invention, for example, sodium perborate tetrahydrate and monohydrate, sodium percarbonate, chlorinated trisodium phosphate and the sodium and potassium salts of dichloroisocyanuric acid. The bleaching agent can also be used in admixture with an aminopolyphosphonic acid, or salt thereof, such as ethylenediamine tetra(methylenephosphonic acid) or diethylenetriamine penta(methylenephosphonic acid), a preferred system of this kind also being disclosed in British Patent Application No. 80/15542.

Soil-suspending agents at about 0.1% to 10% by weight such as water-soluble salts of carboxymethylcellulose, carboxyhydroxymethyl cellulose, polyethylene glycols having a molecular weight of about 400 to 10,000 and copolymers of maleic anhydride with methyl vinyl ether, ethylene or acrylic acid, are common components of the present invention. Dyes, pigment, optical brighteners, and perfumes can be added in varying amounts as desired.

Other materials such as fluorescers, enzymes in minor amounts, anti-caking gents such as sodium sulfosuccinate, and sodium benzoate can also be added. Enzymes suitable for use herein include those discussed in U.S. Pat. Nos. 3,519,570 and 3,533,139 to McCarty and McCary et al issued July 7, 1970 and Jan. 5, 1971 repectively.

Anionic fluorescent brightening agents are well-known materials, examples of which are disodium 4,4'-bis-(2-diethanolamino-4-anilino-s-triazin-6-ylamino) stilbene-2:2' disulphonate, disodium 4,4'-bis-(2-morpholino-4-anilino-s-triazin-6-ylamino stilbene-2:2'-disulphonate, disodium 4,4'-bis-(2,4-dianilino-s-triazin-6-ylamino)stilbene-2:2'-di-sulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'-disulphonate, disodium 4,4'-bis(2-anilino-4-(1-methyl-2-hydroxyethyl-amino)-s-triazin-6-ylamino)stilbene-2,2'disulphonate and sodium 2(stilbyl-4''-(naphtho-1',2':4,5)-1,2,3-triazole-2''-sulphonate.

An alkali metal, or alkaline earth metal, silicate can also be present. The alkali metal silicate is preferably from about 3% to about 8%. Suitable silicate solids have a molar ratio of $SiO_2$/alkali metal$_2$O in the range from about 1.0 to about 3.3, more preferably from about 1.5 to about 2.0.

Additional foam regulating materials can also be incorporated in the compositions of the invention if desired. Suitable materials include the microcrystalline waxes disclosed in British Pat. No. 1,492,938 and $C_{18-22}$ fatty acids or soaps thereof.

Other operational components of the instant compositions include organic peroxyacid precursors such as methyl o-acetoxy benzoate, sodium p-acetoxy benzene sulfonate, Bisphenol A diacetate, tetraacetyl ethylene diamine, tetraacetyl hexamethylene diamine and tetraacetyl methylene diamine. A filler such as an alkali metal sulfate is also a desirable additive, and can be present at levels from about 1% to about 90%, preferably from about 5% to about 30% by weight of the compositions.

In a processing aspect of the invention, the polydimethylsiloxane foam controller is intimately mixed, preferably by high shear mixing, with at least a part of the nonionic surfactant and with siloxane-oxyalkylene dispersing agent in a fluent (if necessary molten) nonionic surfactant phase and the liquid mixture is sprayed, coated or adsorbed onto a base powder granule containing some or all of the remaining ingredients of the composition.

In the Examples which follow, the abbreviations used having the following designation:

| | |
|---|---|
| LAS: | Linear $C_{11.8}$ alkyl benzene sulphonate. |
| $AE_3S$: | Sodium linear $C_{12-14}$ alcohol sulfate including 3 ethylene oxide moieties. |
| $CnAE_6$: | Coconut alcohol ethoxylated with 6 moles of ethylene oxide per mole of alcohol. |
| Dobanol 45-E-7: | A $C_{14-15}$ oxo-alcohol with 7 moles of ethylene oxide, marketed by Shell. |
| Dobanol 45-E-4: | A $C_{14-15}$ oxo-alcohol with 4 moles of ethylene oxide marketed by Shell. |
| TAED: | Tetraacetyl ethylene diamine |
| Silicate: | Sodium silicate having an $SiO_2$: $Na_2O$ ratio of 1.6. |
| Wax: | Microcrystalline wax - Witocodur 272 M.pt 87° C. |
| Silica: | Trimethylsilanated silica, particle size 10 to 20 millimicrons. |
| DC 544: | Commercial mixture of alkoxylated siloxane, siloxane liquid, siloxane resin and aerogel silica, sold by Dow Corning. |
| DC 198: | Alkoxylated siloxane containing oxyethylene and oxypropylene groups, sold by Dow Corning. |
| DC 200: | Polydimethylsiloxane fluid, sold by Dow Corning. |
| Silicone/Silica: | 85:15 by mixture of polydimethylsiloxane and silanated silica. |
| Gantrez AN 119: | Trade Name for maleic anhydride/vinyl methyl ether copolymer, believed to have an average molecular weight of about 240,000 marketed by GAF. This was prehydrolysed with NaOH before addition. |
| Brightener: | Disodium 4,4'-bis(2-morpholino-4-anilino-s-triazin-6-ylamino) |

-continued

| | |
|---|---|
| | stilbene-2:2'-disulphonate. |
| Dequest 2060: | Trade Name for diethylene triamine penta (methylene phosphonic acid), marketed by Monsanto. |
| Dequest 2041: | Trade Name for ethylenediamine tetra (methylene phosphonic acid) marketed by Monsanto. |

The present invention is illustrated by the following non-limiting examples:

EXAMPLES I–VII

The following granular detergent compositions are prepared by mixing all ingredients, apart from nonionic surfactant, bleach, DC544, DC200 and enzyme, in a crutcher as an aqueous slurry, spray-drying the slurry at high temperature in a spray-drying tower to form a base granule, admixing bleach and enzyme with the spray-dried detergent base powder, high shear mixing the nonionic surfactant with DB 544 and DC 200 and spraying the mixture onto the granular base powder.

| | EXAMPLES | | | | | | |
|---|---|---|---|---|---|---|---|
| | I | II | III | IV | V | VI | VII |
| LAS | 4 | 1.5 | — | — | 1.5 | 4.5 | 8 |
| $AE_3S$ | — | — | 3 | — | — | — | — |
| $CnAE_6$ | — | — | 5 | — | 10 | — | — |
| Dobanol 45-E-7 | 8 | 8 | — | 12 | — | 8.5 | 3 |
| Dobanol 45-E-4 | — | 2 | — | 3 | 2 | — | — |
| TAED | — | 5 | — | 2 | — | — | — |
| Silicate | 5 | 7 | 10 | 4 | 2 | 6 | 7 |
| Wax | 0.6 | — | — | 0.5 | — | 0.4 | — |
| Gantrez AN119 | 0.4 | — | — | 1.5 | — | 0.8 | — |
| Brightener | 0.2 | 0.1 | 0.5 | 0.3 | 0.5 | 0.2 | 0.2 |
| DC 544 | 0.04 | 0.04 | 0.04 | 0.07 | 0.06 | 0.05 | 0.03 |
| DC 200 | 0.24 | 0.28 | 0.36 | 0.21 | 0.30 | 0.25 | 0.21 |
| Dequest 2060 | — | 0.2 | — | — | — | — | — |
| Dequest 2041 | 0.1 | — | — | — | — | 0.45 | — |
| EDTA | 0.2 | — | — | 0.1 | — | — | 0.2 |
| Sodium perborate tetrahydrate | 24 | 10 | 20 | 25 | 15 | 22 | 30 |
| Alcalase enzyme | 0.6 | — | — | 1.2 | — | 0.9 | — |
| Sodium tripoly-phosphate | 33 | 36 | 25 | 35 | 50 | 30 | 33 |
| Magnesium sulfate | 0.5 | — | — | — | — | 0.4 | — |
| Sodium sulfate, moisture & miscellaneous | | | | To 100 | | | |

In comparison with detergent compositions based on "self-emulsified" siloxane foam-controllers, the above compositions display superior foam regulation characteristics after prolonged excellent detergency performance without detriment to the "handle" of the fabrics washed therein; and they also provide excellent product dispensing characteristics in drum-type automatic washing machines.

EXAMPLES VIII–XIV

The following granular detergent compositions are prepared by mixing all ingredients, apart from nonionic surfactant, bleach, DC 198, DC 200, silicone, silica and enzyme, in a crutcher as an aqueous slurry, spray-drying the slurry at high temperature in a spray-drying tower to form a base granule, admixing bleach and enzyme with the spray-dried detergent base powder, forming a first mix containing the nonionic surfactant and DC 198, forming a second mix of DC 200 and silica or silicone/silica, combining the two mixes, subjecting the combined mixture to high shear mixing, and finally spraying the mixture onto the granular base powder.

| | EXAMPLES | | | | | | |
|---|---|---|---|---|---|---|---|
| | VII | IX | X | XI | XII | XIII | XIV |
| LAS | 4 | 4.5 | — | — | 1.5 | 4.5 | 6 |
| Tallow alcohol sulfate, sodium salt | — | 2.5 | 3 | — | — | — | — |
| $CnAE_6$ | — | — | 5 | — | 10 | — | — |
| Dobanol 45-E-7 | 8 | 7 | — | 12 | — | 8.5 | 3 |
| Dobanol 45-E-4 | — | — | — | 3 | 2 | — | — |
| TAED | — | 2 | — | — | — | 1 | — |
| Silicate | 5 | 6 | 8 | 5 | 4 | 7 | 6 |
| Wax | 0.6 | — | — | 0.5 | — | 0.4 | — |
| Gantrez AN119 | 0.4 | — | — | 1.5 | — | 0.8 | — |
| Brightener | 0.2 | 0.1 | 0.5 | 0.3 | 0.5 | 0.2 | 0.2 |
| DC 198 | 0.025 | 0.042 | 0.051 | 0.033 | 0.030 | 0.036 | 0.020 |
| DC 200 | 0.22 | 0.25 | 0.26 | 0.32 | 0.35 | 0.25 | 0.20 |
| Silicone/ Silica | 0.05 | — | — | 0.07 | — | 0.02 | 0.02 |
| Silica | — | 0.007 | 0.003 | — | 0.012 | — | 0.002 |
| Dequest 2060 | — | 0.2 | — | — | — | — | — |
| Dequest 2041 | 0.1 | — | — | — | — | 0.45 | — |
| EDTA | 0.2 | — | — | 0.1 | — | — | 0.2 |
| Sodium perborate tetrahydrate | 24 | 10 | 20 | 25 | 15 | 22 | 30 |
| Alcalase enzyme | 0.6 | — | — | 1.2 | — | 0.9 | — |
| Sodium tripoly-phosphate | 33 | 36 | 25 | 35 | 50 | 24 | 33 |
| Magnesium sulfate | 0.5 | — | — | — | — | 0.4 | — |
| Sodium sulfate, moisture & miscellaneous | | | | To 100 | | | |

In comparison with detergent compositions based on "self-emulsified" siloxane foam-controllers, the above compositions display superior foam regulation characteristics after prolonged storage under warm, humid conditions; they provide excellent detergency performance without detriment to the "handle" of the fabrics washed therein; and they also provide excellent product dispensing characteristics in drum-type automatic washing machines.

What we claim is:

1. A foam-controlled detergent composition comprising from 1.5% to 100% of a mixture of:

(a) alkoxylated nonionic surfactant, (b) polydimethylsiloxane foam controller dispersed in at least part of the alkoxylated nonionic surfactant, and (c) siloxane-oxyalkylene copolymer as dispersing agent for the polydimethylsiloxane foam controller, wherein the weight ratio of alkoxylated nonionic surfactant to polydimethylsiloxane foam controller is in the range from 10:1 to 100:1 and the weight ratio of polydimethylsiloxane foam controller to siloxane-oxyalkylene copolymer is in the range from 2:1 to 20:1.

2. A composition according to claim 1 wherein the polydimethylsiloxane foam controller is dispersed in the nonionic surfactant together with particulate silica in a weight ratio of polydimethylsiloxane to silica in the range from 20:1 to 200:1.

3. A composition according to claim 2 wherein the weight ratio of alkoxylated nonionic surfactant to polydimethylsiloxane foam controller is in the range from 25:1 to 65:1 and the weight ratio of polydimethylsiloxane foam controller to siloxane-oxyalkylene copolymer is in the range from 5:1 to 15:1.

4. A composition according to claim 1 wherein the siloxaneoxyalkylene copolymer has the general formula I:

$$R_aSiY_{4-a} \quad \text{I}$$

wherein a is 0 or an integer from 1 to 3, R is an alkyl group containing from 1 to 30 carbon atoms, or a group of formula II:

$$R'(OR')_bOR'' \quad \text{II}$$

wherein R' is an alkylene group containing from 1 to 6 carbon atoms, b has a value of from 1 to 100; and R'' is a capping group which is selected from hydrogen, alkyl, acyl, aryl, alkaryl, aralkyl or alkenyl groups containing up to 20 carbon atoms, sulfate, sulfonate, phosphate, carboxylate, phosphate, borate or isocyanate groups, or mixtures thereof: Y is a group having the formula III:

$$(-O-\underset{\underset{R}{|}}{\overset{\overset{R}{|}}{Si}}-)_c-OSiR_3 \quad \text{III}$$

wherein R is as defined above and c has a value from 1 to 200; and wherein at least one R group in the compound has the formula II.

5. A composition according to claim 4 wherein the siloxane-oxyalkylene copolymer is selected from copolymers having the general formula IV to VII:

$$R'''_aSi\{(OSiMe_2)_p(OSiMeG)_qOSiMe_2G\}_{4-a} \quad \text{IV}$$

$$R'''_aSi\{(OSiMe_2)_p(OSiMeG)_rOSiMe_3\}_{4-a} \quad \text{V}$$

$$GMe_2Si(OSiMe_2)_p(OSiMeG)_qOSiMe_2G, \text{ and} \quad \text{VI}$$

$$Me_3Si(OSiMe_2)_p(OSiMeG)_rOSiMe_3 \quad \text{VII}$$

wherein R''' is a $C_{1-10}$ alkyl group, Me is methyl, G is the group of Formula II, a has a value of 0 or 1, p has a value of at least 1, q has a value of 0 to 50 and r has a value of 1 to 50.

6. A composition according to claim 4 comprising from 2% to 35% of nonionic surfactant and from 0.05% to 0.75% in total of polydimethylsiloxane foam-controller and siloxane-oxyalkylene copolymer dispersing agent in a weight ratio of foam-controller to dispersing agent from 8:1 to 12:1.

7. A granular detergent composition according to claim 1 comprising:

(a) from 30% to 99% of base powder comprising:
  (i) from 1% to 15% of organic surfactant selected from anionic, zwitterionic and ampholytic surfactants and mixtures thereof, and
  (ii) from 5% to 98% of a detergency builder, and
(b) from 1% to 30% of a premix of alkoxylated nonionic surfactant, dispersed polydimethylsiloxane foam controller, and siloxane-oxyalkylene copolymer dispersing agent sprayed in fluent form onto at least a part of the base powder.

8. A process for making a foam-controlled detergent composition comprising from 1.5% to 100% of a mixture of:

(a) alkoxylated nonionic surfactant,
(b) polydimethylsiloxane foam controller, and
(c) siloxane-oxyalkylene copolymer, wherein the weight ratio of alkoxylated nonionic surfactant to polydimethylsiloxane foam controller is in the range from 10:1 to 100:1, and the weight ratio of polydimethylsiloxane foam controller to siloxane-oxyalkylene copolymer is in the range from 2:1 to 20:1, the process comprising forming a surfactant premix comprising at least part of the nonionic surfactant, the polydimethylsiloxane foam controller, and the siloxane-oxyalkylene copolymer and subjecting the premix in fluent form to high shear mixing.

9. A process according to claim 8 comprising the steps of pre-mixing the alkoxylated nonionic surfactant and siloxane-oxyalkylene copolymer dispersing agent, admixing the polydimethylsiloxane foam controller with the surfactant/dispersing agent mixture, and thereafter subjecting the total mixture to high shear mixing.

10. A foam-controlled detergent composition according to claim 1, in which the polydimethylsiloxane is dispersed in all of the alkoxylated nonionic surfactant.

11. A foam-controlled detergent composition according to claim 10, in which the alkoxylated nonionic surfactant is condensation product of primary or secondary aliphatic alcohol having from 8 to 24 carbon atoms with from 2 to about 18 moles of alkylene oxide per mole of alcohol.

12. A foam controlled detergent composition according to claim 11, in which the alkoxylated nonionic surfactant is ethoxylated primary $C_{9-15}$ alcohol having an average degree of ethoxylation ranging from about 2 to 9.

13. A foam-controlled detergent composition according to claim 1, in which the alkoxylated nonionic surfactant is condensation product of primary or secondary aliphatic alcohol having from 8 to 24 carbon atoms with from 2 to about 18 moles of alkylene oxide per mole of alcohol.

14. A foam-controlled detergent composition according to claim 13 in which the alkoxylated nonionic surfactant is ethoxylated primary $C_{9-15}$ alcohol having an average degree of ethoxylation ranging from about 2 to 9.

15. A foam-controlled composition according to claim 2, in which the weight ratio of polydimethylsiloxane to silica is in the range from 25:1 to 100:1.

16. A foam-controlled composition according to claim 12, in which the polydimethylsiloxane foam controller is dispersed in the nonionic surfactant together with particulate silica in a weight ratio of polydimethylsiloxane to silica in the range from 20:1 to 100:1.

17. A foam-controlled composition according to claim 16, in which the siloxane-oxyalkylene copolymer is alkoxylated siloxane containing oxyethylene and oxypropylene groups.

* * * * *